US005875514A

United States Patent [19]

Friess

[11] Patent Number: 5,875,514

[45] Date of Patent: Mar. 2, 1999

[54] PADDED BASKET ROLLER

[75] Inventor: Robert Friess, Wieseth, Germany

[73] Assignee: Friess GmbH, Wieseth, Germany

[21] Appl. No.: 734,437

[22] Filed: Oct. 16, 1996

[30] Foreign Application Priority Data

Oct. 19, 1995 [DE] Germany ..... 195 38 877.1

[51] Int. Cl.[6] ..... B05C 17/02

[52] U.S. Cl. ..... 15/230.11; 15/230.19; 492/13; 492/19; 492/24; 492/29; 492/45; 492/47

[58] Field of Search ..... 15/230.11, 230.19; 492/13, 19, 21, 22, 24, 29, 45, 47

[56] References Cited

U.S. PATENT DOCUMENTS

| | | | |
|---|---|---|---|
| 2,662,269 | 12/1953 | Nash | 15/230.11 X |
| 2,684,497 | 7/1954 | Graham | 15/230.11 X |
| 2,751,618 | 6/1956 | Pruitt | 15/230.11 X |
| 2,889,613 | 6/1959 | Madara | 492/13 X |
| 2,927,334 | 3/1960 | Wonso | 492/29 X |

FOREIGN PATENT DOCUMENTS

| | | | |
|---|---|---|---|
| 113343 | 3/1969 | Denmark | 15/230.11 |
| 1393923 | 2/1965 | France | 15/230.11 |
| 88367 | 1/1967 | France | 492/45 |
| 3014285 | 10/1981 | Germany | 15/230.11 |

*Primary Examiner*—Mark Spisich
*Attorney, Agent, or Firm*—Jordan and Hamburg LLP

[57] ABSTRACT

A paint roller includes a handle rotatably supporting an inner clamping roller, an outer covering roller disposed about and spaced from the inner clamping roller, and a covering material carried by the outer covering roller. A padded layer is disposed between the outer covering roller and the covering material. The outer covering roller has longitudinal ends, and the covering material has longitudinal end sections which extend over the longitudinal ends of the outer covering roller and which are disposed in the space between the inner clamping roller and the outer covering roller.

9 Claims, 2 Drawing Sheets

PADDED BASKET ROLLER

BACKGROUND OF THE INVENTION

The invention relates to a basket roller for a paint roller with a cylindrical support for a covering of plush fabric or the like, the inner cylindrical opening of which is engaged by a bearing leg of an angled handle part wedged and supported with its bearing parts at the inner wall.

In their standard constructions, basket rollers are constructed so that two disks are rotatably mounted at a distance from one another on the bearing leg of the handle part. Such disks are connected together by means of bent spring clips protruding over the outer peripheral areas of the disks. The spring clips can be compressed while being inserted in the inner opening of the cylindrical support and are then jammed in the selected insertion position against the inner wall. This enables the basket roller to be assembled and disassembled very easily. In a modified embodiment, the bent spring clips are omitted and the disks are constructed instead as slotted clamping sleeves, which in turn are jammed against the interior side of the inner opening of the cylindrical support.

Such basket rollers have not previously been obtainable in a padded form, since it created insurmountable difficulties previously to fix the covering ends in a suitable manner when padding was disposed between the cylindrical support and the covering. In the absence of an intermediate padding layer, the covering can be glued to the support, so that the problem of fixing the ends of the covering to the support ends does not arise. If the underside of the covering is lined with a padded layer, which is desirable and, in many cases, even necessary for painting rough plaster in order to be able to bring the paint also into appropriate depressions and also to be able to catch it at elevations, about which paint is not applied when the roller is not padded, it is already known for other types of roller mountings to have the plush covering overlap the ends and pulled into the roller and fixed there. In the case of the conventional basket rollers having a cylindrical supporting sleeve, this pulling in of the overhanging end sections of the plush covering and their clamping by appropriate spring clips fails because, in the case of such a constriction of the internal diameter at the ends, the bearing basket either can no longer be pushed in or cannot be jammed and supported adequately in the interior in the region of the enlarged diameter. In the case of the second of the embodiments, addressed above, namely, the embodiment without the bent spring clips, this pulling in of the ends of the plush covering ends fails because, during the disassembly, the spring clips time and again pull out the plush covering, even when the latter has been glued in.

SUMMARY OF THE INVENTION

It is therefore an object of the invention to develop a basket roller of the initially named type in such a manner, that a padded roller can be constructed in a simple manner.

Pursuant to the invention, this can be accomplished owing to the fact that the support is composed of an inner clamping roller and, at a distance from this, of an outer covering roller, which carries the covering with the interpositioning of a padded layer and between which rollers the overhanging inwardly tucked-in end sections of the covering are jammed.

By means of the inventive arrangement, it is now ensured that, even at the expense of a second sleeve, which would not be required for basket rollers that are not padded, a continuous inner surface of the support, which has a smooth uniform diameter as required for use as a basket roller, is available despite the fact that the ends of the plush covering are pulled in.

Pursuant to a first embodiment of the invention, the construction can be such that short clamping sleeves with external end flanges are disposed between the clamping roller, which is continuous in the axial direction and in one part, and the tucked-in end sections of the covering. These short clamping sleeves already jam and press the covering end sections against the inside of the covering roller and this pressing is reinforced further by the continuous clamping roller, which is pushed in subsequently. At the same time, the end flange of the clamping sleeves not only brings about additional jamming, but also seals the space between the two rollers.

Instead of this clamping roller in one piece, provisions can also be made in accordance with a further embodiment of the invention that the clamping roller, which is provided at both ends with end flanges, is divided in the middle and that the two clamping roller sections are provided with connecting catches, which connect the two clamping roller sections axially. In the case of this construction, the two clamping roller sections can be inserted from the one side and the other after the covering end sections are tucked in and locked together under pressure, so that the end flange, which jams the covering to the ends of the covering roller, at the same time acts as a seal.

In a further development of the invention, provisions can be made for locking so that the clamping roller sections have aligned smooth inner surfaces and that the clamping roller section, having an outwardly expanded accommodating section, has at least sectionally an external diameter corresponding to the internal diameter of the covering roller. By these means, the clamping roller is furthermore supported when installed, in addition to the support from the mountings at the end faces. This leads to greater stiffness and, with that, to a better clamping action of the bearing basket that is to be inserted.

Pursuant to a further development of the present invention to produce a basket roller with a continuous one-part clamping roller, provisions are made so that, after the ends of the covering are tucked into the covering roller and the clamping sleeve is pressed in from one side, the clamping roller is pushed in and threaded into the clamping sleeve there by means of a tapered plug protruding into the other side.

Further advantages, distinguishing features and details of the invention arise out of the following description of two examples as well as from the drawings.

DESCRIPTION OF THE PREFERRED EMBODIMENTS

Figure 1:
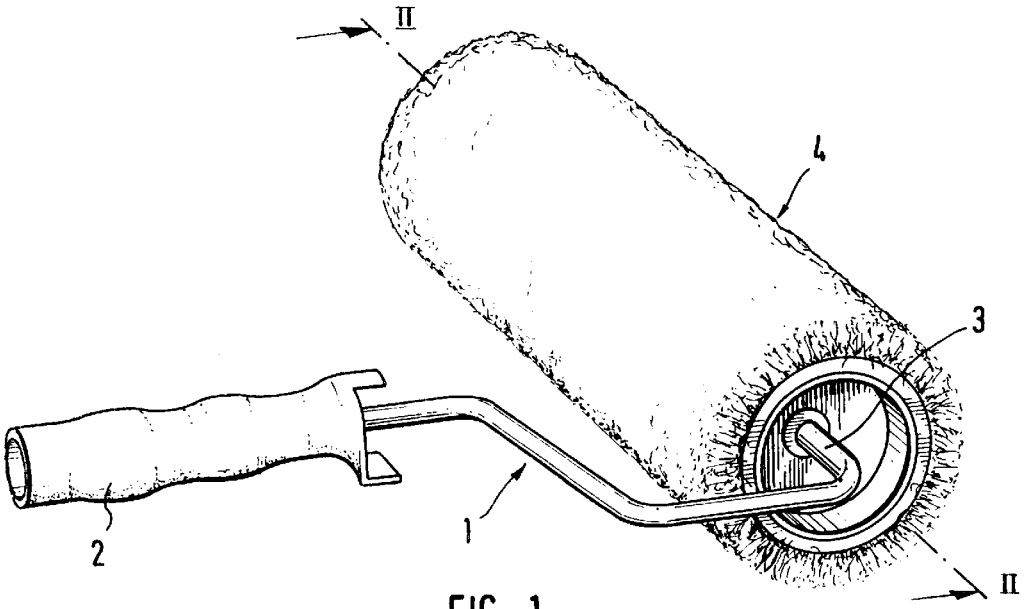
FIG. 1 shows a perspective view of a paint roller with a padded basket roller.

The paint roller, shown in FIG. 1, comprises a multi-angular handle 1, on which is seated a profiled plastic handle 2, onto the supporting leg 3 of which a padded basket roller 4 is pushed and held by being wedged. As can be seen particularly from FIG. 2, the padded basket roller comprises a covering roller 5 of cardboard or plastic, on which there is mounted a padded layer 6 and, over the latter, a covering 7 of plush or some other fiber material. The plush covering 7, which is shown, protrudes at both ends over the supporting covering roller 5, the protruding end sections 8 being tucked in and clamped with short clamping sleeves 9 with end flanges 10 against the covering roller 5. An inner clamping roller 11 is pushed into the clamping sleeves and held once again by being wedged. With that, the counter-pressure effect of the plush end sections 8 is intensified. In the case of the example of FIGS. 1 to 3, said inner clamping roller 11 is constructed in one piece and extends throughout the whole length of the basket roller. The bearing basket 12, which is mounted rotatably on the bearing leg 3 of the handle and consists of the two cylindrical sections 13, between which the outwardly bent spring clips 14 are clamped, engages this clamping roller. The spring clips 14 extend into a peripheral cylindrical surface, which has a diameter, which is larger than that of the internal diameter of the clamping sleeves 11 and that of the external diameter of the cylinder pieces 13. By these means, the bearing basket 12, following the lead of the free cylinder piece 13 on the left side in FIG. 2, can be introduced into the clamping sleeve and can then be shifted, against the clamping action of the clamping hoops 14 in contact with the inner surface of the clamping sleeve 11, into any position, where it is held by the clamping action of these spring clips 14. Admittedly, a basket roller could also be inserted without the additional clamping roller 11. This basket roller would then, however, have to be able to bridge elastically the difference between the internal diameter of the clamping sleeves 9 and the internal diameter of the covering roller 5. In practice, this is impossible. For this reason, padded basket rollers have never been described or offered previously.

Figure 2:
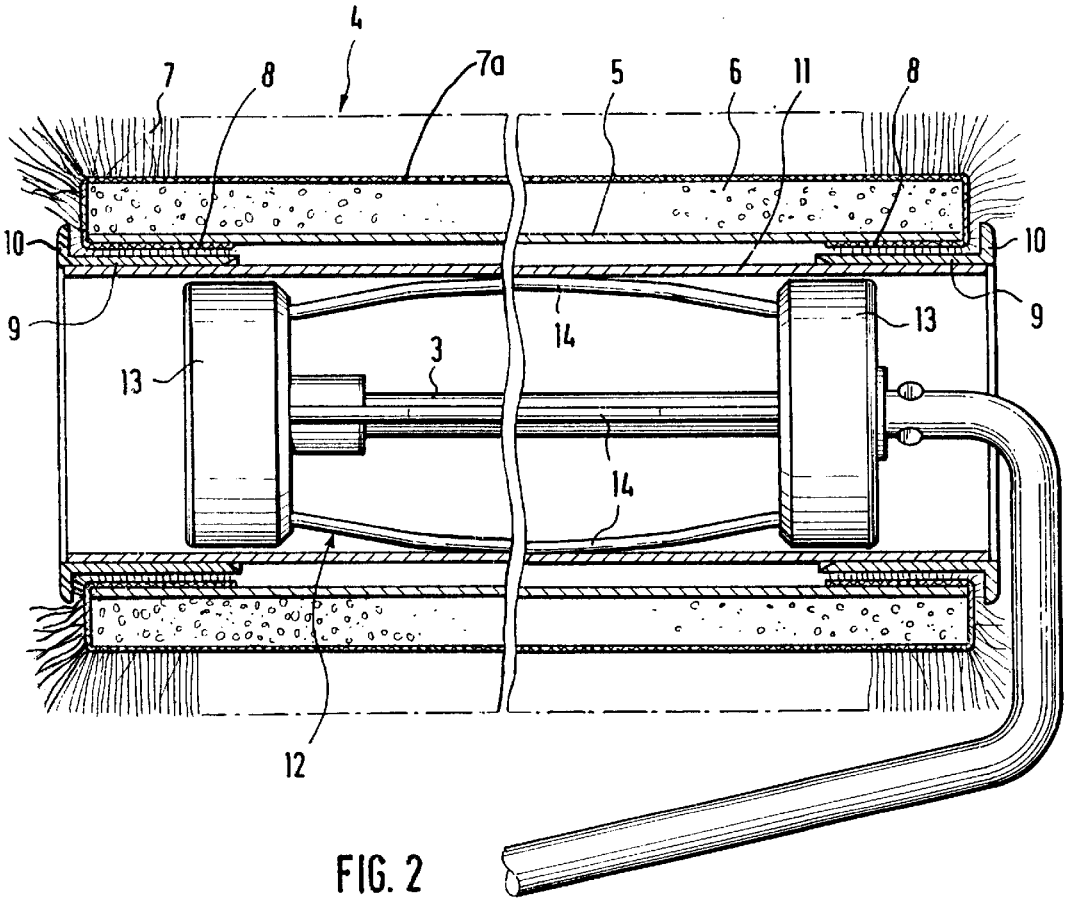
FIG. 2 shows an enlarged longitudinal section through the basket roller along the line II—II of FIG. 1.

The basket roller of FIG. 2 is assembled by first of all placing the padded layer 6 and the plush covering tube 7 on the covering roller 5 and subsequently tucking the ends 8 of the covering inward and securing them by pressing-in the clamping sleeves 9. Subsequently, the clamping roller 11 is pushed in, for example, from the right, while the opposite end is disposed on a tapered installation plug 15. This tapered installation plug, with its stringing point 16, ensures that the free leading end of the clamping roller 11 is guided in such a manner, that it is guided precisely into the clamping sleeve 9 on the left side without encountering the danger that the clamping sleeve 9 is pushed out during the assembly of the clamping roller 11. The beveling 17 of the inner front end of the clamping sleeve 9 also serves for this purpose.

Figure 3:
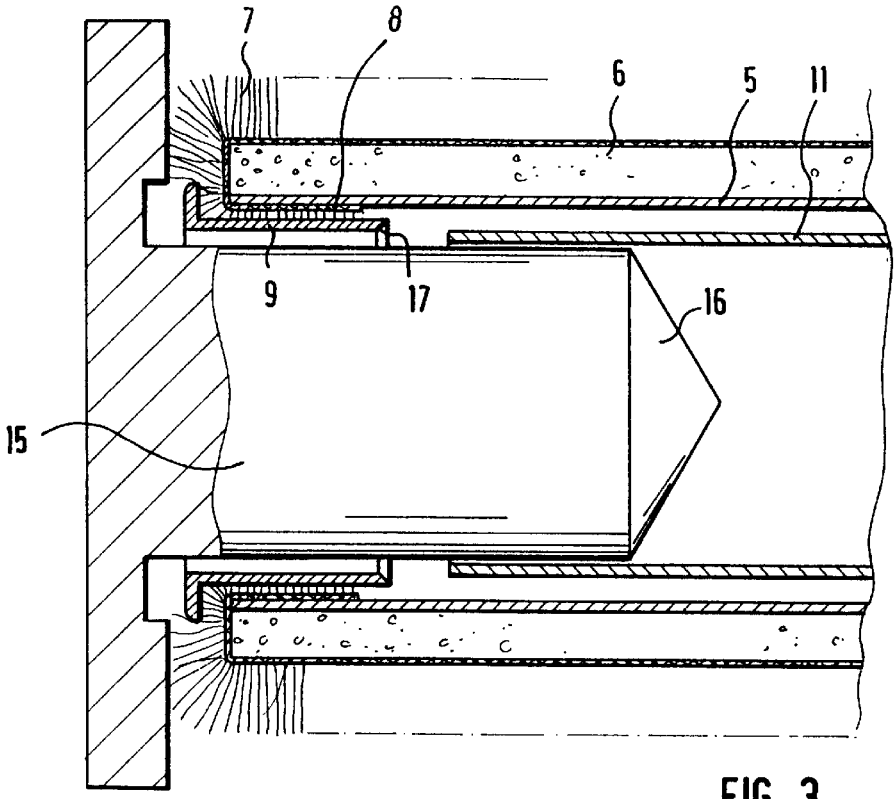
FIG. 3 shows a section through an end of the basket roller of FIG. 2 during the installation of the inner clamping roller with the help of a tapered installation plug.
Figure 4:
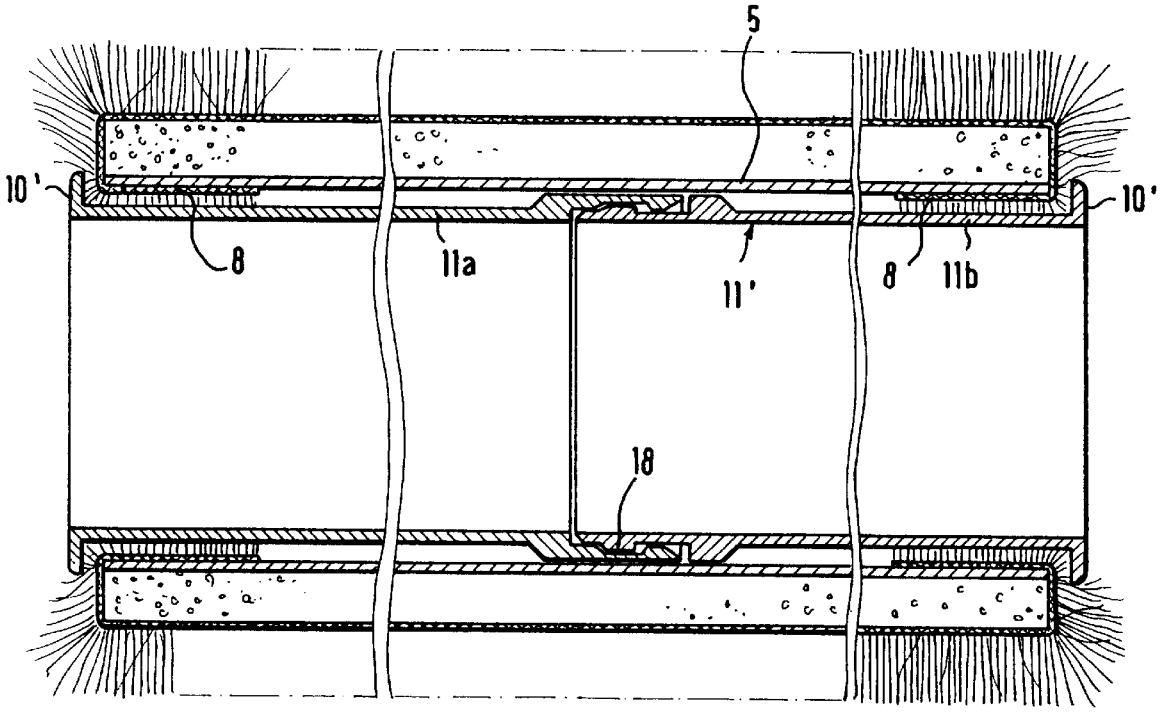
FIG. 4 shows a section, similar to that of FIG. 2, through the basket roller of a modified embodiment with a divided clamping roller.

The embodiment of a basket roller, shown in FIG. 4, differs from that of FIGS. 1 and 3 owing to the fact that the clamping roller 11' is divided in the middle. The clamping roller sections 11*a* and 11*b* are provided with catches, which bring about an axial connection when these sections are pressed in. Section 11*a* comprises an outwardly expanded accommodating section for the end of the other clamping section 11*b*. The external diameter of the accommodating section corresponds essentially to the internal diameter of the covering sleeve 5. As a result, aside from the clamping mounting of the outer ends of the clamping roller sections 11*a* and 11*b*, which are held by being wedged against the tucked-in covering sections 8—in FIG. 4, the distance that results after the plush threads are compressed is disproportionally large—there is also support in the center. This prevents sagging occurring too easily, as a result of which the clamping action of the bearing basket, which is to be inserted into the aligned smooth continuous inner surfaces of the clamping roller sections 11*a* and 11*b*, is improved. Because of the division of the clamping roller 11', the clamping sleeves have been omitted for the example of FIG. 4 and the end flange 10' has been integrally molded directly to the clamping roller 11'.

An example of the padded layer 6 is a foam material such as polyurethane foam, polyester foam or polyether foam. An example of the plush covering 7 is synthetic fiber or also lambskin, lamb's wool, or the like material which is suitable for absorbing paint. The plush covering 7 is provided on an inner pipe 7*a* which may be made, for example, of polypropylene.

What I claim is:

1. A paint roller comprising a handle, a cylindrical support means rotatably supported by said handle, said cylindrical support means comprising an inner clamping roller, an outer covering roller disposed about and spaced from said inner clamping roller, a covering material carried by said outer covering roller, a padded layer disposed between said outer covering roller and said covering material, said outer covering roller having longitudinal ends, said covering material having longitudinal end sections which extend over said longitudinal ends of said outer covering roller and disposed in the space between said inner clamping roller and said outer covering roller, said inner clamping roller comprising a first longitudinal section and a second longitudinal section which is separable from said first longitudinal section, and connecting means connecting said first and second longitudinal sections, said outer covering roller having an inner diameter, said connecting means having an outer diameter substantially equal to said inner diameter of said outer covering roller.

2. A basket roller comprising a handle having a handle leg, a rotary device rotatably mounted on said handle leg, a padded device mounted on said rotary device, said padded device including a hollow inner clamping roller having an inner cylindrical wall, said rotary device including disks disposed in said hollow inner clamping roller, said disks having an outer diameter substantially equal to the inner diameter of said inner cylindrical wall, said rotary device including engaging means engaging said inner cylindrical wall to preclude relative rotational movement between said inner clamping roller and said rotary device, said padded device including an outer clamping roller disposed about and spaced from said inner clamping roller, said padded device further comprising a covering material carried by said outer clamping roller, said padded device further comprising a padded layer disposed between said outer clamping roller and said covering material, said outer clamping roller having longitudinal ends, said covering material having longitudinal end sections which extend over said longitudinal ends of said outer clamping roller and which are disposed in the space between said inner clamping roller and said outer clamping roller, said inner cylindrical wall of said hollow inner clamping roller being a smooth and uniform cylindrical wall throughout the longitudinal length of said inner cylindrical wall such that said disks of said rotary device are longitudinally slidable into and out of said hollow inner clamping roller along said smooth and uniform cylindrical wall to facilitate removal and replacement of the padded device on the rotary device.

3. A basket roller according to claim 2 further comprising clamping sleeves disposed between said inner clamping roller and said longitudinal end sections of said of said covering material.

4. A basket roller according to claim 3 wherein said clamping sleeves have outer longitudinal ends, said outer longitudinal ends having flanges.

5. A basket roller according to claim 4 wherein said covering material extends over longitudinal ends of said outer clamping roller, said covering material being disposed between said longitudinal ends of said inner clamping roller and said flanges on said clamping sleeves.

6. A basket roller according to claim 2 wherein said inner clamping roller comprises a first longitudinal section and a second longitudinal section which is separable from said first longitudinal section, and connecting means connecting said first and second longitudinal sections.

7. A basket roller according to claim 6 wherein the longitudinal length of said first longitudinal section is substantially equal to the longitudinal length of said second longitudinal section.

8. A basket roller according to claim 3 wherein each clamping sleeve is a hollow cylindrical sleeve having an inner cylindrical sleeve surface, said inner cylindrical sleeve surface having an inner diameter, said inner clamping roller having an outer diameter substantially equal to said inner diameter of said inner cylindrical sleeve surface.

9. A basket roller according to claim 8 wherein said hollow cylindrical sleeve has an outer cylindrical sleeve surface, said outer cylindrical sleeve surface having an outer diameter, longitudinal end sections of said covering material being disposed in a generally cylindrical configuration which has an end section inner diameter and an end section outer diameter, said end section inner diameter being substantially equal to said outer diameter of said outer cylindrical sleeve surface, said outer clamping roller having an inner diameter substantially equal to said end section outer diameter.

* * * * *